US006260232B1

(12) United States Patent
Nelson et al.

(10) Patent No.: US 6,260,232 B1
(45) Date of Patent: Jul. 17, 2001

(54) SURFACE CLEANING APPARATUS

(76) Inventors: Marc O. Nelson, 14061 92nd Pl. North; Earl E. Martens, 10085 99th Ave. North, both of Maple Grove, MN (US) 55369

( * ) Notice: Subject to any disclaimer, the term of this patent is extended or adjusted under 35 U.S.C. 154(b) by 0 days.

(21) Appl. No.: 09/397,464

(22) Filed: Sep. 16, 1999

Related U.S. Application Data

(60) Provisional application No. 60/101,276, filed on Sep. 22, 1998.

(51) Int. Cl.[7] ..... A47L 11/30

(52) U.S. Cl. ..... 15/322; 15/321; 15/393; 15/415.1

(58) Field of Search ..... 15/321, 322, 393, 15/415.1; 401/13, 219

(56) References Cited

U.S. PATENT DOCUMENTS

| | | | | |
|---|---|---|---|---|
| 1,575,939 | * | 3/1926 | Satterwhite etal. | 15/393 |
| 1,601,774 | * | 10/1926 | Scheffer | 15/415.1 |
| 2,240,005 | * | 4/1941 | Moyer | 15/393 |
| 2,506,077 | * | 5/1950 | Goldsmith | 15/322 |
| 2,893,048 | * | 7/1959 | Martinec | 15/393 |
| 2,949,620 | * | 8/1960 | Noble | 15/321 |
| 3,258,809 | * | 7/1966 | Harvey | 15/321 |
| 3,281,885 | * | 11/1966 | Hersh | 15/393 |
| 3,464,081 | * | 9/1969 | Wisner | 15/322 |
| 3,783,473 | * | 1/1974 | Engquist | 15/322 |
| 4,437,203 | * | 3/1984 | Wisner | 15/322 |
| 4,649,594 | * | 3/1987 | Grave | 15/322 |
| 4,833,752 | * | 5/1989 | Merrick | 15/322 |
| 5,343,591 | * | 9/1994 | Clark | 15/322 |
| 6,021,545 | * | 2/2000 | Delgado et al. | 15/322 |

* cited by examiner

*Primary Examiner*—Robert J. Warden, Sr.
*Assistant Examiner*—Theresa T. Snider

(57) ABSTRACT

An apparatus for cleaning a surface has a handle joined to a cleaning head operable to dispense liquid onto a surface to be cleaned, mechanically work up dirt, film and particulates from the surface into a vacuum unit. The cleaning head has a cylindrical core supporting a sleeve that rotates on a cylindrical member as the head moves relative to the surface to be cleaned. Nozzles located within the cleaning head discharge liquid into the core and sleeve. The sleeve distributes the liquid onto the surface to be cleaned. A modification of the apparatus has nozzles located adjacent the sleeve that dispenses liquid to a surface. The sleeve when subjected to vacuum picks up the liquid and dirt from the surface. A further modification has a cleaning head with an internal chamber closed with a removable base and pad. A nozzle located within the chamber discharges liquid to the pad. The liquid and dirt collected by the pad are drawn into the chamber by vacuum.

22 Claims, 11 Drawing Sheets

SURFACE CLEANING APPARATUS

CROSS REFERENCE TO RELATED APPLICATION

This application claims priority of U.S. Provisional Application Ser. No. 60/101,276 filed Sep. 22, 1998.

FIELD OF THE INVENTION

The invention is in the field of surface cleaning devices that dispense cleaning liquids on the surface and extracts with vacuum the cleaning liquids, dirt, dust, and particulates from the surface.

BACKGROUND OF THE INVENTION

Conventional fluid pressure cleaning equipment utilize manually operated cleaners that dispense liquids, including water, onto the surface of floors and walls and mechanically scrub the surfaces. These cleaners have housings connected to elongated handles used by work persons to move the housing relative to the surface to be cleaned. Spinners having nozzles rotatably mounted on the housing discharge cleaning liquid onto the surface. Brushes attached to the housing are used to mechanically scrub the surfaces. The cleaning liquid is spread over the surface and in time evaporates. An example of this type of cleaning equipment is disclosed by H. A. Petsch in U.S. Pat. No. 3,829,019.

Cleaning devices having vacuum cleaner heads including nozzles to discharge water onto the surface to be cleaned are disclosed by H. W. Schneider in U.S. Pat. No. 4,282,626. Brushes are used on the cleaner heads to mechanically scrub the surface.

SUMMARY OF THE INVENTION

The surface cleaner of the invention has a cleaning head that dispenses a cleaning liquid onto a surface to be cleaned to wet and dissolve foreign materials, such as dirt, dust, film, molds, oils, grease, bacteria, fungi, pollen, and particulates on the surface, mechanically scrub the surface, and remove with vacuum liquid and foreign materials from the surface. The surfaces include building walls, windows, floors, vehicles, and objects having surfaces that are cleaned. Heating, ventilating, and air conditioning equipment can be cleaned to remove dust, dirt, bacterial, and fungal growth with the cleaner of the invention. The cleaner has a cleaning head that includes a cylindrical member accommodating a rotatable core supporting a porous sleeve that rotates as it is moved relative to a surface to be cleaned. An elongated tubular handle connected to the cleaning head is used by the work person to move the cleaning head. The handle is connected to a vacuum unit with a hose that transports air, liquid and foreign materials from the cleaning head to the vacuum unit. A pump operates to deliver cleaning liquid, such as water, to a flexible tube located in the handle and hose and connected to a tube within the cleaning head. Nozzles mounted on the tube dispense cleaning liquid into the sleeve which spreads the liquid on to the surface to be cleaned. The core and sleeve have a number of holes that allow cleaning liquid to be dispensed on the surface to be cleaned and permit the vacuum to pick up liquid, film and dirt from the surface leaving the surface dry and clean. The sleeve is a porous cylinder made from fabric, plastic fibers, felt, and rubber like materials. The cleaning head effectively cleans the surface without injecting liquid sprays into the atmosphere. Environmental contamination of the atmosphere is substantially reduced. A modification of the cleaning head has a rotatable porous sleeve mounted on a core rotatably supported on a cylindrical member. The inside of core and sleeve are subjected to vacuum which draws liquid and dirt through the sleeve into the cylindrical member. A hose connected to the cleaning head transports the liquid, air, and dirt to a vacuum pump and collection sump. A liquid dispenser located adjacent the sleeve directs a cleaning liquid onto the surface to be cleaned. The cleaning liquid dislodges and incorporates foreign material, such as dusk, dirt, oils, grease, and particulates on the surface. The porous sleeve when subjected to vacuum picks up the foreign materials from the surface.

The surface cleaner is incorporated in a cleaning head having an internal chamber subjected to a vacuum. A nozzle located within the chamber directs a cleaning liquid to a porous pad mounted on a base. The pad distributes the liquid onto the surface to be cleaned. The pad also picks up that liquid, foreign materials and air from the surface when subjected to a vacuum.

DESCRIPTION OF THE PREFERRED EMBODIMENTS OF THE SURFACE CLEANING APPARATUS OF THE INVENTION

Figure 1:
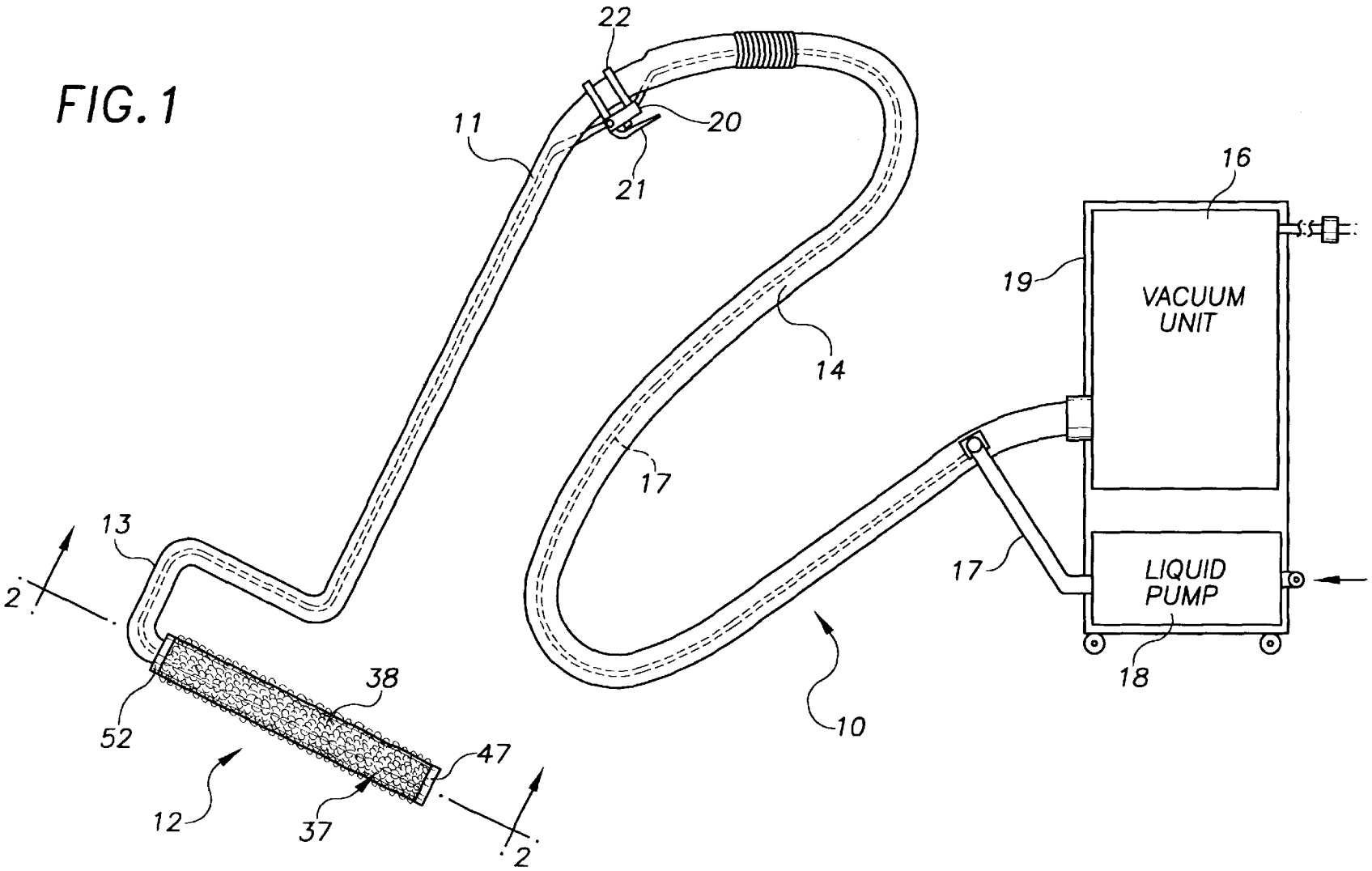
FIG. 1 is a perspective view of the SURFACE CLEANING APPARATUS of the invention connected to a vacuum unit and liquid pump.

The surface cleaning apparatus of the invention, indicated generally at 10 in FIG. 1, has an elongated linear tubular handle 11 connected to a cleaning head 12 with a U-shaped tubular neck 13. A flexible hose 14 connects the upper outlet end of handle 11 with a vacuum unit 16. Vacuum unit 16 has a motor driven blower used to draw air, molds, fungi, bacteria, pollen, dirt, oils, greases, liquid and particulates through cleaning head 12, neck 13, handle 11, and hose 14 and into vacuum unit 16. The air is discharged to atmosphere. The dirt, liquid, and particulates are collected in a tank located in vacuum unit 16. Vacuum unit 16 is operated with a variable speed electric motor which controls the amount of vacuum pressure. Examples of vacuum unit 16 are a shop vacuum machine and the vacuum and liquid dispensing machine disclosed in U.S. Pat. No. 4,809,396.

A tube 17 for carrying liquids, such as water and cleaning solutions, is located within the passages of handle 11, neck 13 and hose 14. Tube 17 is an elongated flexible hose connected at one end to cleaning head 12 and at the opposite end to a liquid pump 18. Pump 18 operates to supply liquid under pressure to tube 17 at pressures in the range of 35 to 100 psi. The pressure of the liquid discharged by pump 18 can vary according to the conditions of the surface to be cleaned. The recommended maximum liquid pressure does not exceed 1100 psi.

Vacuum unit 16 and liquid pump 18 are housed in a cabinet or housing 19 to facilitate transport of surface cleaning apparatus 10. Vacuum unit 16 and liquid pump 18 can be separate power equipment having individual controls for operating the equipment. Remote controllers can be used by the work persons to control the ON and OFF functions of the vacuum unit 16 and liquid pump 18. ON and OFF switches associated with vacuum unit 16 and pump 18 are manually operated to control the operations of vacuum unit 16 and pump 18.

The flow of liquid in tube 17 is controlled with a valve assembly 20 interposed in tube 17 at the upper end of handle 11. A hand operated lever 21 is used by the work person to open valve assembly 20 to allow liquid to flow into cleaning head 12. A connector 22, such as a clamp, mounts valve assembly 20 on handle 11 in a location that is convenient for use by the work person.

Figure 2:
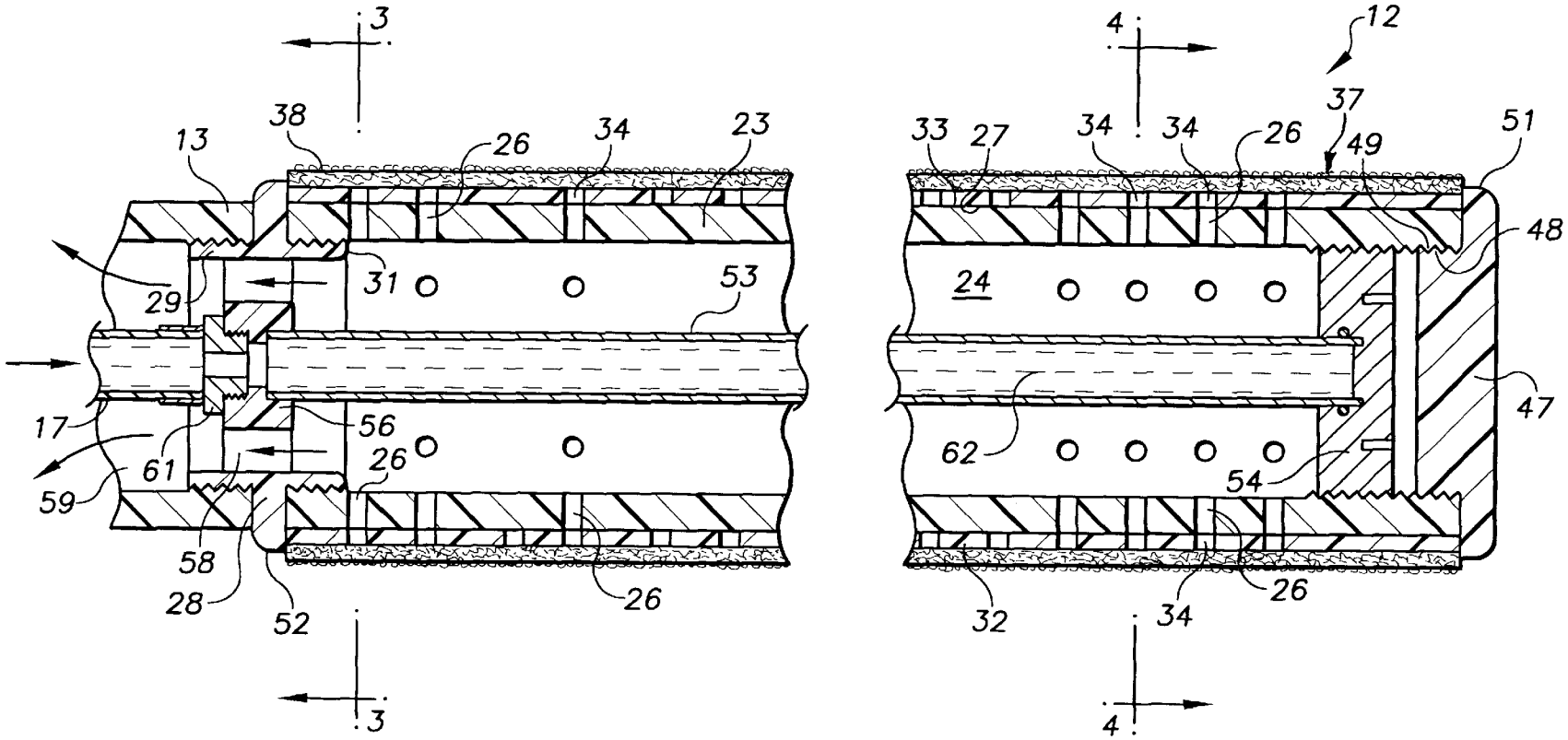
FIG. 2 is an enlarged and foreshortened sectional view taken along line 2—2 of FIG. 1.
Figure 4:
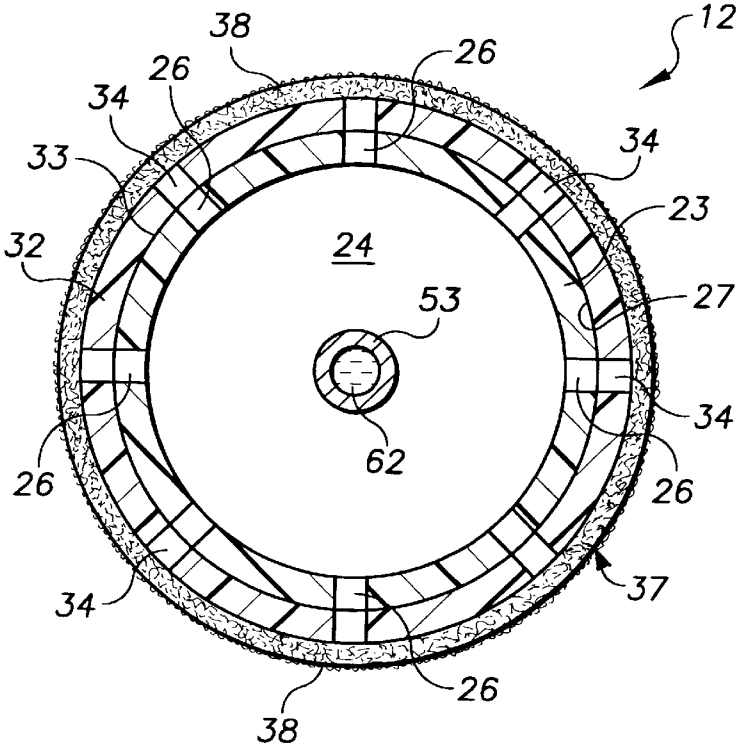
FIG. 4 is an enlarged sectional view taken along line 4—4 of FIG. 2.
Figure 3:
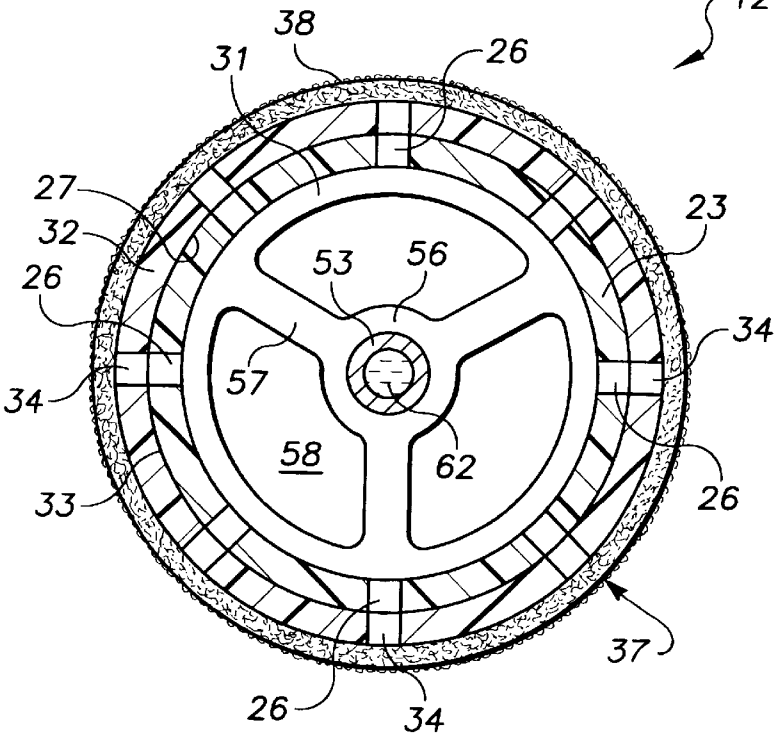
FIG. 3 is an enlarged sectional view taken along line 3—3 of FIG. 2.

Cleaning head 12, shown in FIGS. 2, 3, and 4, has a rigid cylindrical member 23 having an internal chamber 24 and a plurality of rows of holes or orifices 26. Holes 26 are open to chamber 24 and the cylindrical outer surface 27 of member 23. The number, size and locations of the holes can be changed to increase or decrease the flow of air, liquid, and dirt through member 23 into chamber 24.

A connector 28 secures an end of member 23 to neck 13. Connector 28 has threaded annular portions 29 and 31 threaded into adjacent ends of neck 13 and member 23. Member 23 can be a linear extension of neck 13. Connector 28 can be replaced with an annular ring secured to the outside of member 23 to provide a shoulder 52 for a cylindrical core 32 positioned about member 23.

As shown in FIGS. 2 to 5, a cylindrical core 32 surrounding member 23 has a cylindrical inside surface 33 located in sliding surface engagement with the outer cylindrical surface 27 of member 23. Member 23 is a plastic tubular member having a low coefficient of friction, such as high density polyethylene. This permits core 32 to freely rotate on member 23. Core 32 has rows of radial holes 34 circumferentially spaced from each other. The rows of holes 34 are laterally spaced along the length of core 32. Some of the rows of holes 34 are radially aligned with the rows of holes 26 in member 23, as seen in FIGS. 2–4. Holes 34 are open to inside surface 33 and the outer cylindrical surface 36 to allow air and liquid to flow through core 32.

Figure 7:
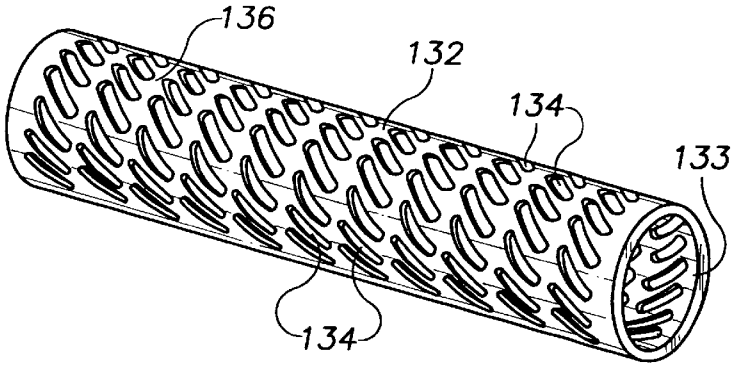
FIG. 7 is a perspective view first modification of the cylindrical core of the surface cleaning head.
Figure 8:
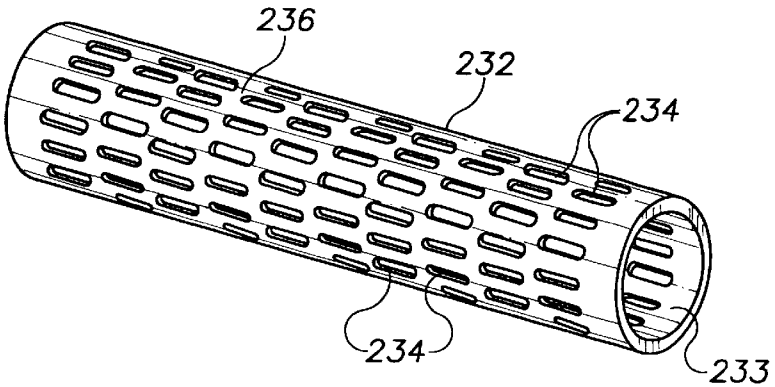
FIG. 8 is a perspective view of a second modification of the cylindrical core of the surface cleaning head.

Modifications of the core are shown in FIGS. 7 and 8. Core 132, shown in FIG. 7, is an elongated linear cylindrical tube having an outer cylindrical surface 136. Core 132 has rows of angled slots 134 along the entire length of the tube. Slots 134 are open to the cylindrical inside surface 133 and outside surface 136 to allow liquid to flow through the tube to a sleeve, indicated generally at 37 in FIGS. 1 to 5, mounted on the tube. Slots 134 also allow air, liquid and dirt to be drawn form the sleeve back into the chamber 24 of member 23. Core 232, shown in FIG. 8, is a cylindrical tube having a cylindrical inner surface 233 and cylindrical outer surface 236. Rows of longitudinal slots 234 in the tube allow liquid to flow through the tube into sleeve 37 surrounding the tube. Slots 234 also allow air, liquid and dirt to be drawn from the sleeve back into chamber 24 of member 23.

Figure 9:
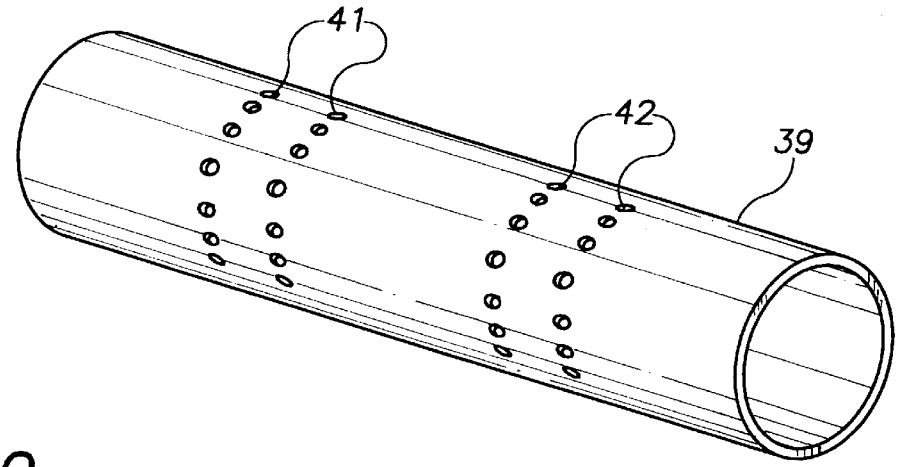
FIG. 9 is a perspective view of a first modification of the cylindrical sleeve of the surface cleaning head.
Figure 10:
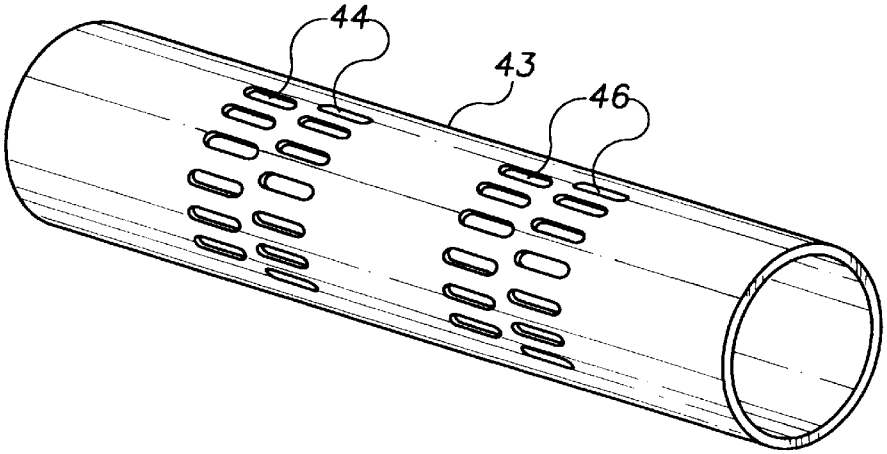
FIG. 10 is a perspective view of a second modification of the cylindrical sleeve of the surface cleaning head.

Cylindrical sleeve 37 located about core 32 has a cylindrical outer surface 38 contacts, scrubs, and rubs on the surface during cleaning of the surface. Sleeve 37 is a porous cylinder made from fabric, plastic fibers, felt, artificial chamois, and rubber like materials. Sleeve 37 rolls on the surface to be cleaned and dislodges particulates, dirt and films that collect on the surface. Sleeve 37 also spreads liquid cleaning solution on the surface and allows the vacuum force to draw air through the sleeve to pick up liquid cleaning solution, dirt, oil and particulates from the surface. FIGS. 9 and 10 show alternative embodiments of the sleeve for use on core 32. Sleeve 39, shown in FIG. 9, is a cylindrical tubular member having a first pair of holes 41 and a second pair of holes 42 laterally spaced from each other on opposite sides of the center of the sleeve. Sleeve 43, shown in FIG. 10, is a cylindrical tubular member having a first pair of rows of longitudinal slots 44 and a second row of longitudinal slots 46 laterally spaced from each other on opposite sides of the center of sleeve 43. Other sizes and arrangement of holes in the sleeve can be used.

Core 32 and sleeve 37 are retained in concentric relationship on cylindrical member 23 with an end cap 47 having a threaded boss 48. Boss 48 turns into threads 49 in the outer end of member 23. Cap 47 has an annular rim 51 that engages the ends of core 32 and sleeve 37. The opposite ends of core 32 and sleeve 37 engage an annular flange 52 joined to connector 28. Rim 51 and flange 52 restrict axial movement of core 32 and sleeve 37 on member 23 and allow substantially free rotation of core 32 and sleeve 37 on member 23.

Returning to FIGS. 2, 3, and 4, an elongated tube 53 in chamber 24 extends along the axis of cylindrical member 23. A plug 54 threaded into the outer end of member 23 holds and seals the end of tube 53. The opposite end of tube 53 is mounted on a central hub 56. Spokes 57 join hub 56 to connector 28. Spokes 57 are circumferentially spaced from each other and provide passages 58 between chamber 24 and passage 59 in neck 13 to allow liquid and particulates to flow from chamber 24 into passage 59 and downstream through handle 11, hose 14, and into vacuum unit 16.

Figure 5:
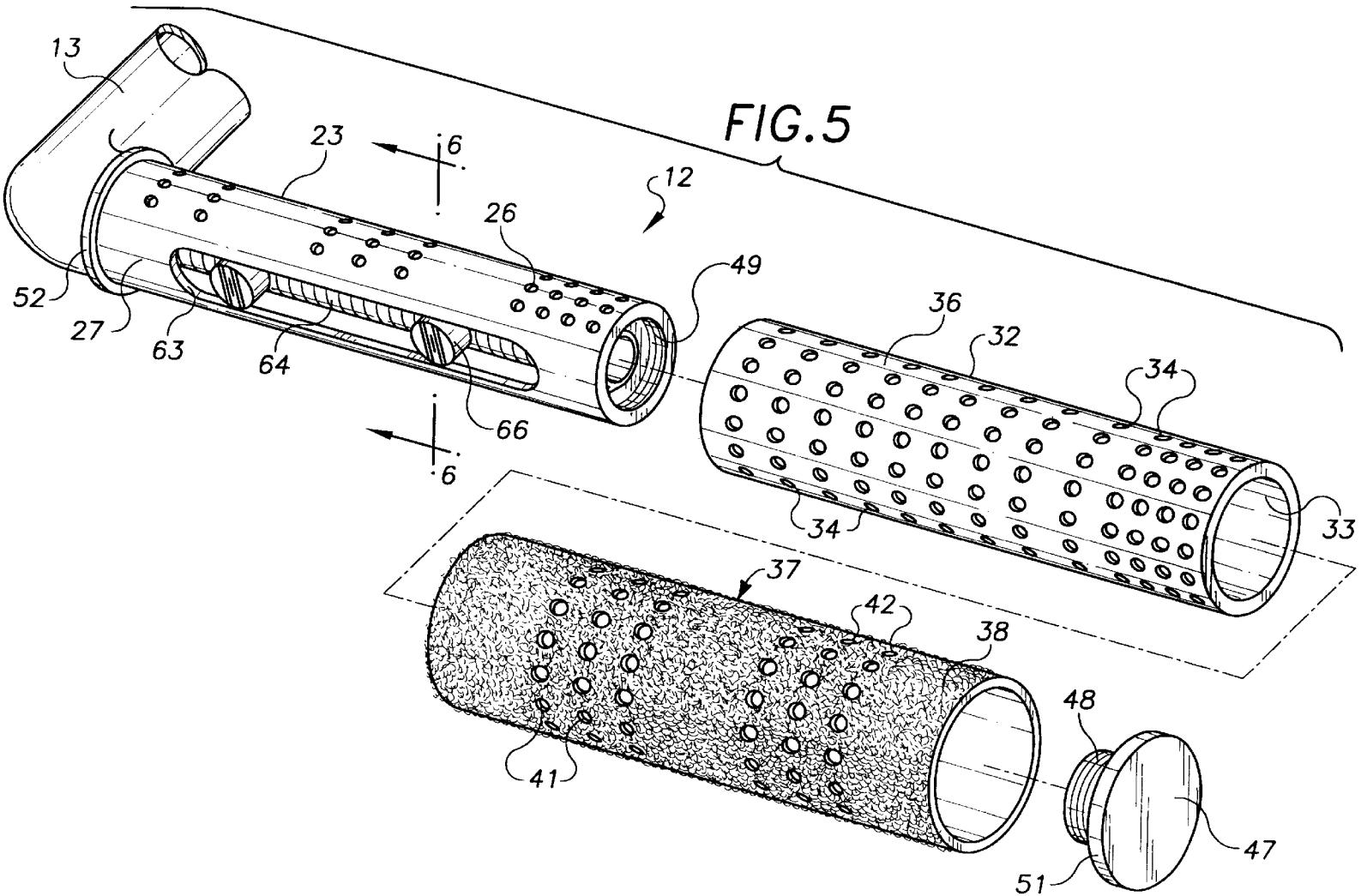
FIG. 5 is an exploded perspective view of the surface cleaning head shown in FIG. 1.

A coupling 61 connects tube 17 to hub 56 to direct liquid under pressure into passage 62. As shown in FIG. 5, tubular member 23 has a longitudinal slot 63 in the forward side of member 23. A pair of nozzles 64 and 66 secured to tube 53 project into slot 63. Nozzles 64 and 66 direct streams of liquid 71 into the holes 34 in core 32 and holes 42 in sleeve 37. Additional nozzles can be attached to tube 53 to increase the amount of liquid dispensed into holes 34 in core 32. The liquid flows into sleeve 37 which spreads the liquid on the surface to be cleaned.

Figure 6:
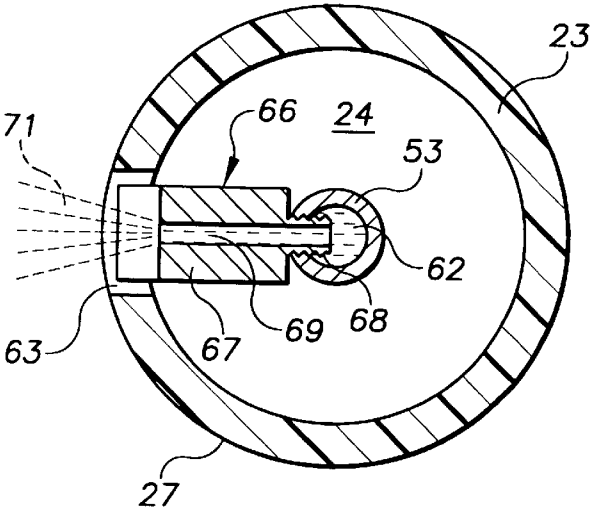
FIG. 6 is an enlarged sectional view taken along line 6—6 of FIG. 5.

Nozzle 64 and 66 are identical in structure and function. As shown in FIG. 6, nozzle 66 has a cylindrical body 67 joined to an end 68 threaded into tube 53. Body 67 and end 68 has a common passage 69 for carrying liquid from tube passage 62 and discharging the liquid toward core 32. Holes 34 in core 32 distribute the liquid along the length of sleeve 37. Liquid is dispensed to the surface to be cleaned through holes 42 in sleeve 37 and porous material of sleeve 37. Value assembly 20 is manually operated by the work person to control the flow of liquid to tube 53 and nozzles 64 and 66.

Figure 11:
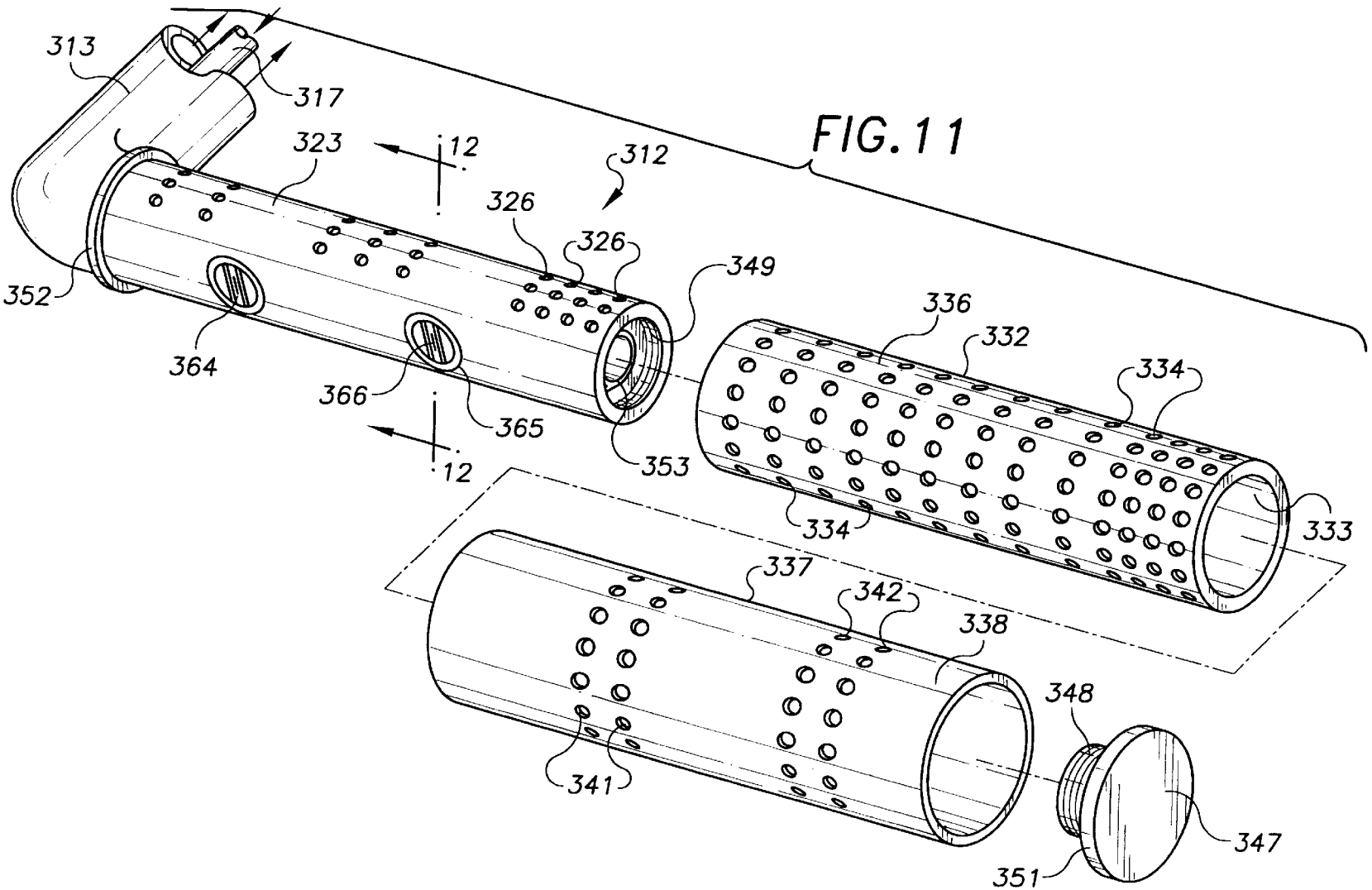
FIG. 11 is an exploded perspective view of a modification of the surface cleaning head shown in FIG. 1.
Figure 12:
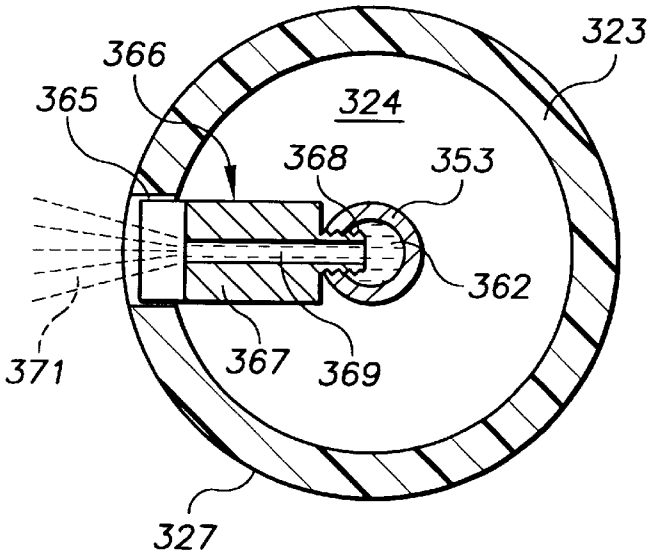
FIG. 12 is an enlarged sectional view taken along the line 12—12 of FIG. 11.

A modification of the cleaning head for the cleaning apparatus is shown in FIGS. 11 and 12. Cleaning head 312 is coupled to the hose with a tubular neck 313 joined to a transverse linear tubular member 323. As seen in FIG. 12, member 323 has an internal chamber 324 in communication with a plurality of rows of holes or orifices 326 which allow air, dirt, and particulates to be drawn into passage 324 when head 312 is subjected to vacuum. The number, size, and locations of holes 326 can be changed to regulate air flow through the holes 326 in member 323. The amount of vacuum pressure in chamber 324 also relates to the rate of air flow through the holes 326 in member 323. Member 323 has a smooth outer cylindrical surface 327 that is in surface contact with a cylindrical core 332.

Core 332 is a linear tube having an inside cylindrical surface 333 and an outside cylindrical surface 336. An array of holes 334 extend through core 332. Core 332 is a plastic tubular member having a low coefficient of friction, such as high density polyethylene. This permits core 332 to freely rotate on member 323. Core 332 has rows of radial holes 334 circumferentially spaced from each other. The rows of holes 334 are laterally spaced along the length of core 332. Some of the rows of holes 334 are radially aligned with the rows of holes 326 in member 323. Holes 334 are open to inside surface 333 and the outer cylindrical surface 336 to allow air and liquid to flow through core 332. A cylindrical sleeve 337 located about core 332 has a cylindrical outer surface 338 which contacts, scrubs, and rubs on the surface during cleaning of the surface. Sleeve 337 is a porous cylinder made from fabric, plastic fibers, felt, artificial chamois, and rubber like materials. Sleeve 337 rolls on the surface to be cleaned and dislodges particulates, dirt and films that collect on the surface. Sleeve 337 also spreads liquid cleaning solution on the surface and allows the vacuum force to draw air through the sleeve to pick up liquid cleaning solution, dirt, oil, and particulates from the surface.

Core 332 and sleeve 337 are retained in concentric relationship on cylindrical member 323 with an end cap 347 having a threaded boss 348. Boss 348 turns into threads 349 in the outer end of member 323. Cap 347 has an annular rim 351 that engages the ends of core 332 and sleeve 337. The opposite ends of core 332 and sleeve 337 engage an annular flange 352. Rim 351 and flange 352 restrict axial movement of core 332 and sleeve 337 on member 323 and allow substantially free rotation of core 332 and sleeve 337 on member 323.

As shown in FIG. 12, an elongated tube 353 located along the longitudinal axis of passage 324 is connected to tube 317 which carries cleaning liquid, such as water, under pressure to tube 353. The tube 353 is mounted on member 323 with structures as shown in FIGS. 2, 3, and 4. Other mounting structures can be used to hold tube 353 on member 323. A pair of nozzles 364 and 366 connected to tube 353 discharge cleaning liquid into the holes 334 in core 332. As shown in FIG. 12, nozzle 366 has a cylindrical body 367 joined to a thread end 368 turned into tube 353. Body 367 and end 368 has a common passage 369 for carrying cleaning liquid from tube passage 362 to core 332. The outer end of body 367 has a close fit with the member 332 surrounding hole 365 to restrict cleaning liquid from flowing through hole 365. Nozzle 364 has the same structures and functions of nozzle 366. Holes 334 in core 332 distribute the liquid 371 along the length of sleeve 337. Liquid is dispensed to the surface to be cleaned through holes 341 and 342 in sleeve 337 and porous material of sleeve 337. Value assembly 20 is manually operated by the work person to control the flow of liquid to tube 353 and nozzles 364 and 366.

In use, the work person uses handle 11 to move cleaning head 12 over the surface to be cleaned. Hose 14 couples the upper end of handle 11 to vacuum unit 16 and tube 17 connects cleaning head 12 to pump 18. Vacuum unit draws air through sleeve 37, core 32 and into chamber 24 of member 23. Air flows through the holes in sleeve 37, core 32 and member 23. Air also flows through slot 63 into chamber 24. The flowing air picks up liquid, dirt, film and particulates from the surface and from the sleeve. These materials are carried with the flowing air from chamber 24 through handle 11 and hose 14 to vacuum unit 16. Core 32 and sleeve 37 turn and rotate on cylindrical member 23 as cleaning had 12 is moved over the surface to be cleaning. The rotating sleeve 37 mechanically works the dirt of film, and particulates from the surface so that they can be incorporated with the cleaning liquid. The air flowing through sleeve 37 and core 32 picks up the cleaning liquid, dirt and particulates and carries them to vacuum unit 16. The vacuum unit 16 separates the air from the liquid, dirt, and particulates which are collected in a tank or container in vacuum unit 16. Valve assembly 20 is used by the work person to regulate the flow of liquid to nozzles 64 and 66 which discharge liquid into core 32 and sleeve 38. Cleaning head 12 can be used without the use of cleaning liquid to pick-up moisture from the surface.

Figure 14:
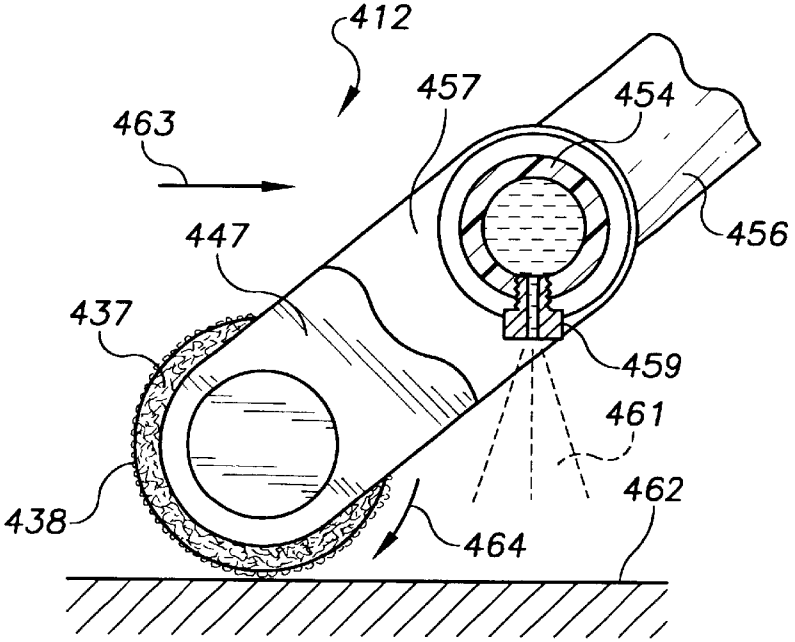
FIG. 14 is an enlarged sectional view taken along line 14—14 of FIG. 13.
Figure 13:
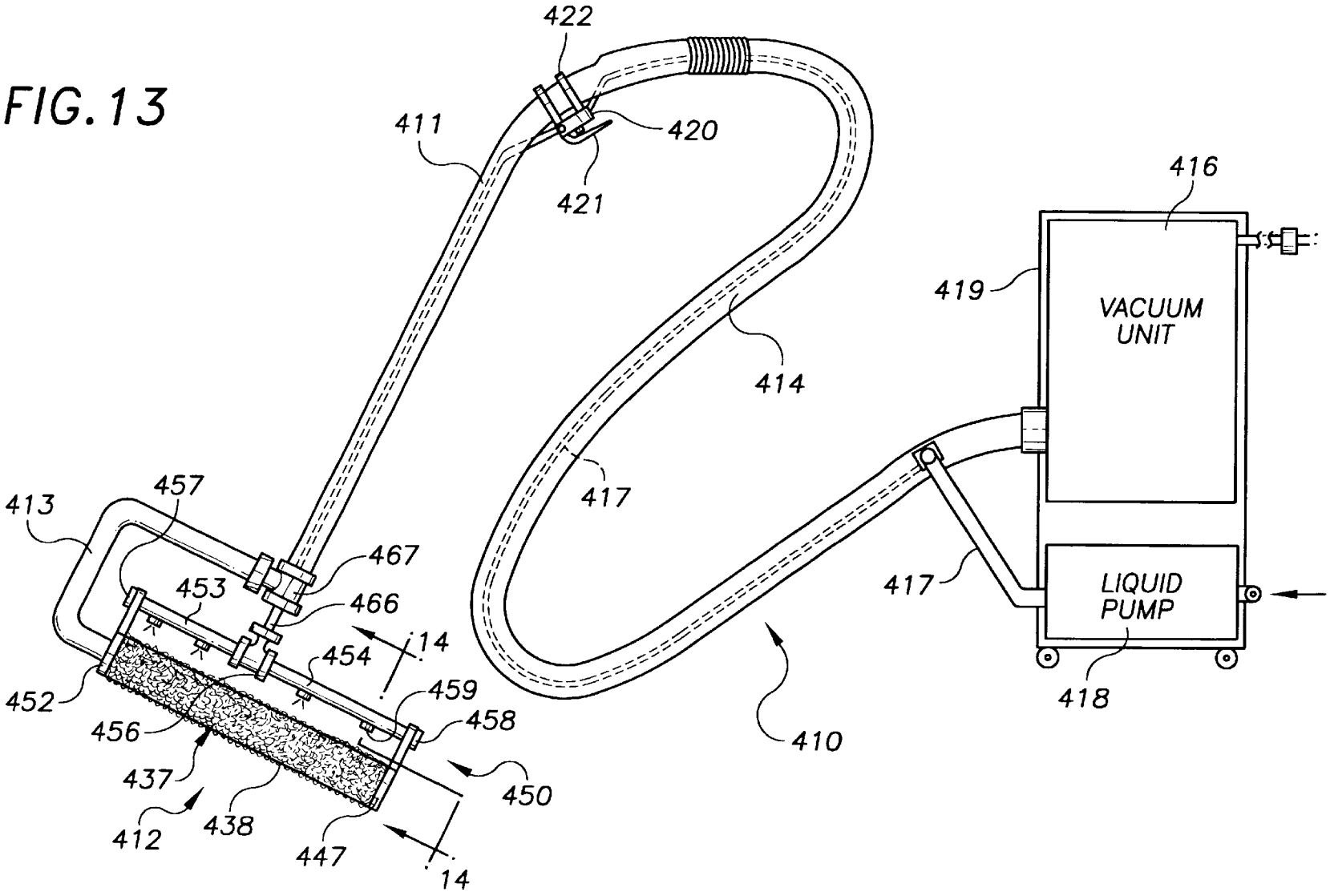
FIG. 13 is a perspective view of a first modification of the surface cleaning apparatus of the invention connected to a vacuum unit and liquid pump.

A modification of the surface cleaning apparatus is shown in FIGS. 13 and 14. The surface cleaning apparatus indicated generally at 410 in FIG. 13, has an elongated linear tubular handle 411 connected to a cleaning head 412 with a U-shaped tubular neck 413. A flexible hose 414 connects the upper outlet end of handle 411 with a vacuum unit 416. Vacuum unit 416 has a variable speed motor driven blower used to draw air, molds, bacteria, fungi, pollen, dirt, liquid, and particulates through cleaning head 412, neck 413, handle 411, and hose 414 and into vacuum unit 416. The air is discharged to atmosphere. The dirt, liquid, and particulates are collected in a tank located in vacuum unit 416. Examples of vacuum unit 416 are a shop vacuum machine and the vacuum and liquid dispensing machine disclosed in U.S. Pat. No. 4,809,396.

A tube 417 for carrying liquids, such as water and cleaning solutions, is located within the passages of handle 411 and hose 414. Tube 417 is an elongated flexible hose connected at one end to cleaning head 412 and at the opposite end to a liquid pump 418. Pump 418 is operated to supply liquid under pressure to tube 417 at pressures to the range of 35 to 100 psi. The pressure of the liquid discharged by pump 418 can vary according to the conditions of the surface to be cleaned. The recommended maximum liquid pressure does not exceed 1100 psi.

The vacuum unit 416 and liquid pump 418 are housed in a cabinet or housing 419 to facilitate transport of surface cleaning apparatus 410. Vacuum unit 416 and liquid pump 418 can be separate power equipment having individual controls for operating the equipment. Remote controller can be used by the work persons to control the ON and OFF functions of the vacuum unit 416 and liquid pump 418. ON and OFF switches associated with vacuum unit 416 and pump 418 are manually operated to control the operations of vacuum unit 416 and pump 418.

The flow of liquid in tube 417 is controlled with a valve assembly 420 interposed in tube 417 at the upper end of handle 411. A hand operated lever 421 is used by the work person to open valve assembly 420 to allow liquid to flow toward cleaning head 412. A connector 422 mounts valve assembly 420 on handle 411 in a location that is convenient for use by the work person.

Cleaning head 412 has the same structure as cleaning head 12 shown in FIGS. 2–4 except for the liquid carrying tube and nozzles within sleeve 437. Sleeve 437 has an outer surface 438 that rolls on the surface 462 to dislodge and pick-up liquid, dust, dirt, and particulates from the surface when sleeve 437 is subjected to vacuum.

A cleaning liquid dispenser 450 located adjacent sleeve 437 operates to discharge cleaning liquid 461 onto surface 462 in front of sleeve. As shown in FIG. 14, when cleaning head 412 is moved in the direction of arrow 463, sleeve 437 rotates in the direction or arrow 464. The air moving toward and into sleeve 437 picks up the liquid on surface 462 and dirt, dust, and particulates entrained in the air and liquid.

Liquid dispenser 450 has a pair of tubes 453 and 454 attached to a T coupling 456. The outer ends of tubes 453 and 454 extend through holes in arms 452 and 447. Caps 457 and 458 threaded on tubes 453 and 454 close the ends of tubes 453 and 454 and retain tubes 453 and 454 on arms 452 and 447. Tubes 453 and 454 can be rotated to change the angular positions of nozzles 459 relative to sleeve 437 and the angle of the liquid stream 461 relative to the surface 462. The outer or lower ends of arms 447 and 452 are connected to the support member for sleeve 437.

Cleaning liquid from tube 417 flows through a tube 466 connected to T coupling 456 and a T coupling 467 joined to the lower end of handle 411. T coupling 456 is connected to tubular neck 413 so that air, liquid, dirt, and particulates flow from neck 413 to handle 411. The air flowing in hose 414 transports the liquid, dirt and particulates to vacuum unit 416.

Figure 15:
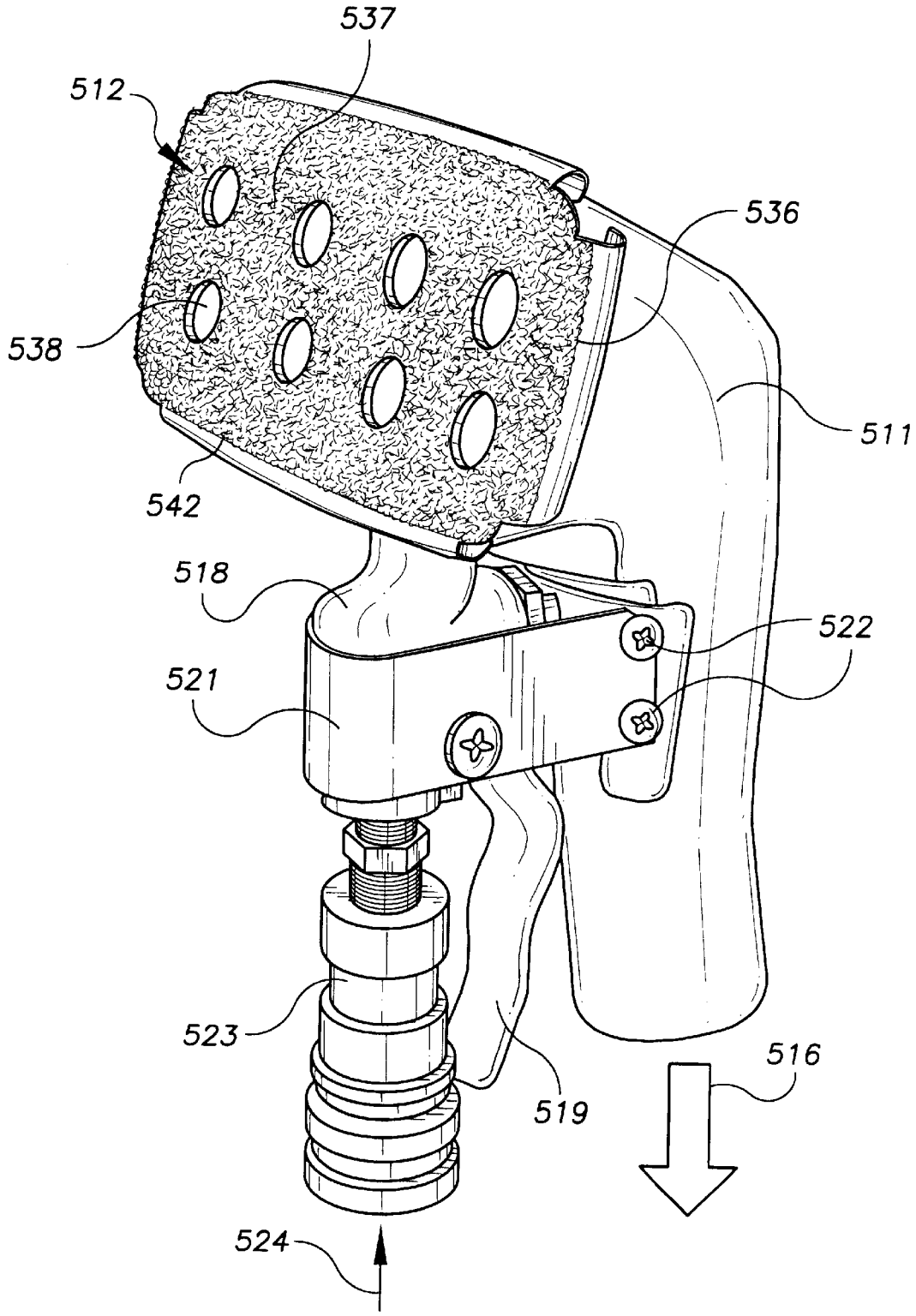
FIG. 15 is a perspective view of a second modification of the surface cleaning apparatus.
Figure 16:
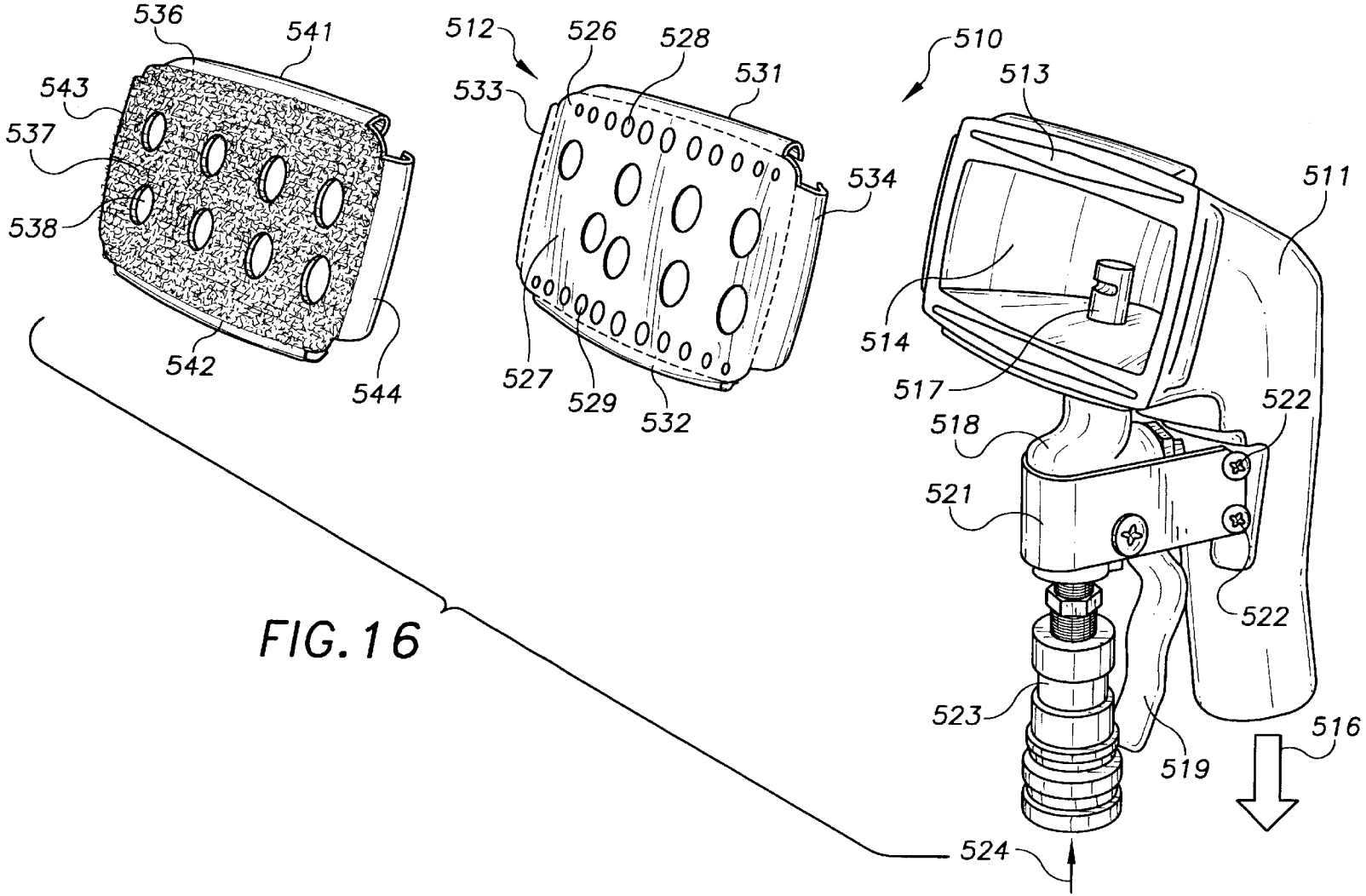
FIG. 16 is an exploded perspective view of the surface cleaning apparatus of FIG. 15.

Another modification of the surface cleaning apparatus is shown in FIGS. 15 and 16. Surface cleaning apparatus, indicated generally at 510, has a handle 511 with a passage open to a tube for carrying air and liquid shown by arrow 516. Handle 511 is joined to a cleaning head 512 for applying cleaning liquid to a surface, scrub the surface, and extract liquid and dirt from the surface.

Cleaning head 512 has a housing 513 joined to handle 511 and an internal chamber 514 with a front opening. A nozzle 517 mounted on the bottom of housing 513 extends up into chamber 514 and directs a stream of cleaning liquid toward the front opening. An ON-OFF valve assembly 518 mounted on the bottom of housing 513 and connected to nozzle 517 controls the flow of cleaning liquid to nozzle 517. A lever or trigger 519 operatively connected to valve 518 is manually operated to open valve 518 to dispense cleaning liquid through nozzle 517. A U-shaped bracket 521 attached to handle 511 with bolts 522 secures valve 518 to handle 511. Valve 518 is coupled to a hose connector 523 to carry cleaning liquid, shown by arrow 524, under pressure to valve 518. A hose connected to a pump delivers the cleaning fluid to connector 523.

A base or pad holder 526 comprising a generally rectangular plate having two row of large holes 527 arranged across the middle section of the plate and two rows of small holes 528 and 529 along opposite top and bottom sides of the plate. Clip flanges 531, 532, 533 and 534 along the top, bottom and opposite sides of the plate clamp onto housing 513. A generally rectangular pad 536 of porous material, such as fabric, plastic, fibers, felt, artificial chamois, and rubber like materials, fit over the holder 526. The pad 536 has central holes 538 generally aligned with holes 527 in the plate. The outer peripheral edge of pad 527 has clip flanges 541, 542, 543, and 544 that fit over flange 531–534 of holder 526. Flanges 541–544 allow pad 536 to be removed from holder 526 and replaced with an new pad or a pad having different material or surface characteristics.

In use, the work person uses handle 511 to move cleaning head 512 over the surface to be cleaned. The vacuum unit connected to handle 511 draws air through holder 526 and pad 536 and into chamber 514 of housing 513. Air flows through the holes 527 and 538 in holder 526 and pad 536. The flowing air picks up liquid, dirt, film and particulates from the surface and from the pad 536. These materials are carried with the flowing air from chamber 514 through handle 511 and the hose to the vacuum unit. Valve 518 is used by the work person to regulate the flow of liquid to nozzles 517 which discharge liquid into holder 526 and pad 536. Cleaning head 512 can be used without the use of cleaning liquid to pick-up moisture from the surface.

There has been shown and described several embodiments of the surface cleaning apparatus of the invention, it is understood that changes in the parts and arrangement of parts and materials may be made by one skilled in the art without departing from the invention.

What is claimed is:

1. An apparatus for cleaning a surface comprising: an elongated tubular handle having a passage, a cleaning head connected to the handle, means for providing a vacuum to the passage of the tubular handle, tubular means for carrying a liquid located within the passage of the handle to the cleaning head, pump means connected to the tubular means operable to supply liquid under pressure to the tubular means, valve means connected to the tubular means for controlling the flow of liquid through the tubular means, said cleaning head having a rigid cylindrical member with an internal chamber open to the passage in the handle, a plurality of first holes in the cylindrical member open to the chamber, means securing the member to the handle, a cylindrical core surrounding the cylindrical member, a plurality of second holes in the core open to the cylindrical member, cylindrical sleeve means located around said core, said sleeve means comprising a porous member operable to dislodge particulates, dirt and films from a surface and allow air, liquid, particulates, dirt and films to move through the porous member, a tube located in the internal chamber of the cylindrical member connected to the tubular means for accommodating liquid from the tubular means, means mounting the tube on the cylindrical member, nozzle means connected to the tube operable to direct liquid into the second holes in the core and third holes in the sleeve means whereby the sleeve means spreads the liquid on the surface to be cleaned, said liquid on the surface being drawn through the sleeve means along with air, particulates, dirt and films by the vacuum into the chamber of the cylindrical member and passage of the handle.

2. The apparatus of claim 1 including: a U-shaped tubular neck connecting the handle to the cylindrical member.

3. The apparatus of claim 1 wherein: the tubular means is an elongated flexible hose connected to the pump means and cleaning head for carrying liquid from the pump means to the tube in the cleaning head.

4. The apparatus of claim 1 including: cabinet means for accommodating the means for providing a vacuum and the pump means.

5. The apparatus of claim 1 wherein: the valve means has a lever and a valve moveable to open and closed positions, said lever useable by a person to move the valve from the closed position to the open position.

6. The apparatus of claim 1 wherein: a number of the second holes are radially aligned with the first holes to allow air and liquid to flow through the core.

7. The apparatus of claim 1 wherein: the second holes are angled slots.

8. The apparatus of claim 1 wherein: the sleeve means has third holes to allow air, liquid and particulates to flow through the sleeve means.

9. The apparatus of claim 8 wherein: the third holes comprise first longitudinal slots and second longitudinal slots laterally spaced from the first longitudinal slots.

10. The apparatus of claim 1 wherein: the nozzle means have bodies extended into the first holes of the cylindrical member whereby the nozzle means directs liquid into the second holes in the core and third holes in the sleeve means.

11. An apparatus for cleaning a surface comprising: a handle having a passage, a cleaning head connected to the handle, means for providing a vacuum to the passage of the handle, tubular means for carrying liquid to the cleaning head, pump means connected to the tubular means operable to supply liquid under pressure to the tubular means, liquid dispensing means connected to the tubular means to direct liquid on the surface to be cleaned, said cleaning head having a cylindrical member with an internal chamber open to the passage in the handle, first hole means in the cylindrical member open to the chamber, means securing the member to the handle; a cylindrical core rotatably mounted on the cylindrical member, porous sleeve means located around the core operable to dislodge particulates, dirt and film from the surface to be cleaned and allow air, liquid and particulate, dirt and films to move through the sleeve means, said liquid on the surface being drawn through the sleeve means along with air, particulates, dirt, and films by the vacuum into the chamber of the cylindrical member and passage of the handle.

12. The apparatus of claim 11 including: a U-shaped tubular neck connecting the handle to the cylindrical member.

13. The apparatus of claim 11 wherein: the tubular means is an elongated flexible hose connected to the pump means and cleaning head for carrying liquid from the pump means to the cleaning head.

14. The apparatus of claim 11 including: cabinet means for accommodating the means for providing a vacuum and the pump means.

15. The apparatus of claim 11 including: valve means having a lever and a valve movable to open and closed positions, said lever useable by a person to move the valve from the closed position to the open position.

16. The apparatus of claim 11 wherein: said core having second hole means open to the cylindrical member, aligned with the first hole means to allow air and liquid to flow through the core.

17. The apparatus of claim 16 wherein: the second hole means are angled slots.

18. The apparatus of claim 16 wherein: the sleeve means has third hole means to allow air, liquid and particulates to flow through the sleeve means.

19. The apparatus of claim 18 wherein: the third hole means comprise first longitudinal slots laterally spaced from the first longitudinal slots.

20. The apparatus of claim 11 wherein: the tubular means is located within the passage of the handle.

21. The apparatus of claim 11 including: valve means mounted on the handle operable to control the flow of liquid in the tubular means to the nozzle means.

22. The apparatus of claim 11 wherein: the liquid dispensing means includes nozzle means for spraying liquid onto the surface to be cleaned.

* * * * *